US006018220A

United States Patent [19]

Nerone

[11] Patent Number: 6,018,220

[45] **Date of Patent: *Jan. 25, 2000**

[54] GAS DISCHARGE LAMP BALLAST CIRCUIT WITH A NON-ELECTROLYTIC SMOOTHING CAPACITOR FOR RECTIFIED CURRENT

[75] Inventor: Louis R. Nerone, Brecksville, Ohio

[73] Assignee: General Electric Company, Schenectady, N.Y.

[ * ] Notice: This patent is subject to a terminal disclaimer.

[21] Appl. No.: 09/009,374

[22] Filed: Jan. 20, 1998

Related U.S. Application Data

[63] Continuation-in-part of application No. 08/897,345, Jul. 21, 1997, and a continuation-in-part of application No. 09/001,391, Dec. 31, 1997, abandoned.

[51] Int. Cl.[7] ..... H05B 37/02

[52] U.S. Cl. ..... 315/219; 315/DIG. 2; 315/DIG. 7; 315/224; 315/244; 315/209 R

[58] Field of Search ..... 315/209 R, DIG. 2, 315/DIG. 7, 307, 219, 224, 244; 363/22, 23, 97, 133

[56] References Cited

U.S. PATENT DOCUMENTS

| | | | |
|---|---|---|---|
| 4,370,600 | 1/1983 | Zansky | 315/244 |
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,614,897 | 9/1986 | Kumbatovic | 315/224 |
| 4,647,817 | 3/1987 | Fahnrich et al. | 315/104 |
| 4,667,345 | 5/1987 | Nilssen | 315/209 R |
| 4,692,667 | 9/1987 | Nilssen | 315/209 R |
| 4,734,828 | 3/1988 | Vargo | 363/22 |
| 4,937,470 | 6/1990 | Zeller | 307/270 |
| 4,945,278 | 7/1990 | Chern | 315/209 R |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,355,055 | 10/1994 | Tary | 315/209 R |
| 5,387,847 | 2/1995 | Wood | 315/209 R |
| 5,406,177 | 4/1995 | Nerone | 315/307 |
| 5,446,347 | 8/1995 | Nilssen | 315/209 R |
| 5,514,981 | 5/1996 | Tam et al. | 326/80 |

OTHER PUBLICATIONS (Anonymous), "Samsung Electronics KA7514A Industrial," Samsung Electronics, Korea (1996), CD–ROM (Edition 3.0), printed as pp. 1–5.

*Primary Examiner*—Michael Shingleton

[57] ABSTRACT

A ballast circuit for a gas discharge lamp includes a rectifier coupled to convert current from an a.c. source to d.c. current provided on bus and reference conductors. A smoothing capacitance, coupled between the bus and reference conductors, smooths current supplied by the rectifier. A resonant load circuit includes a resonant inductance, a resonant capacitance, and means to connect to the lamp. A d.c.-to-a.c. converter circuit, coupled to the resonant load circuit, induces an a.c. current in the resonant load circuit. The converter circuit comprises first and second switches serially connected between the bus and reference conductors, and being connected together at a common node through which the a.c. load current flows. The switches each comprise a reference node and a control node, the voltage between such nodes determining the conduction state of the associated switch. The respective reference nodes of the switches are interconnected at the common node. The respective control nodes of the switches are interconnected. A control circuit for controlling the switches includes an inductance connected between the control nodes and the common node. A starting pulse-supplying capacitance is connected in series with the inductance, between the control nodes and the common node. A network is connected to the control and common nodes for supplying the starting pulse-supplying capacitance with charge so as to create a starting pulse thereacross during lamp starting effective on its own to start one of the switches. The capacitance substantially comprises at least one dry-type capacitor.

14 Claims, 6 Drawing Sheets

GAS DISCHARGE LAMP BALLAST CIRCUIT WITH A NON-ELECTROLYTIC SMOOTHING CAPACITOR FOR RECTIFIED CURRENT

This is a continuation-in-part of application Ser. No. 08/897,345, filed on Jul. 21, 1997, and a continuation-in-part of application Ser. No. 09/001,391, filed on Dec. 31, 1997 now abandoned.

FIELD OF THE INVENTION

The present invention relates to ballasts, or power supply, circuits for gas discharge lamps of the type employing regenerative gate drive circuitry for controlling a pair of serially connected switches of a d.c.-to-a.c. converter. A first aspect of the invention relates to such a ballast circuit employing an inductance in the gate drive circuitry to adjust the phase of voltage for controlling the converter switches. A second aspect of the invention, claimed herein, relates to the mentioned type of ballast circuit employing a circuit for starting regenerative operation of the gate drive circuity while allowing the use of a durable, dry-type capacitor for smoothing the output of an a.c.-to-d.c. rectifier. By "dry-type" capacitor is meant in the specification and claims a non-electrolytic capacitor, i.e., a capacitor not using a wet or partially wet electrolyte, which is subject to evaporation and early component failure.

BACKGROUND OF THE INVENTION

Regarding a first aspect of the invention, typical ballast circuits for a gas discharge lamp include a pair of serially connected MOSFETs or other switches, which convert direct current to alternating current for supplying a resonant load circuit in which the gas discharge lamp is located. Various types of regenerative gate drive circuits have been proposed for controlling the pair of switches. For example, U.S. Pat. No. 5,349,270 to Roll et al. ("Roll") discloses gate drive circuitry employing an R-C (resistive-capacitive) circuit for adjusting the phase of gate-to-source voltage with respect to the phase of current in the resonant load circuit. A drawback of such gate drive circuitry is that the phase angle of the resonant load circuit moves towards 90° instead of toward 0° as the capacitor of the R-C circuit becomes clamped, typically by a pair of back-to-back connected Zener diodes. These diodes are used to limit the voltage applied to the gate of MOSFET switches to prevent damage to such switches. The resulting large phase shift prevents a sufficiently high output voltage that would assure reliable ignition of the lamp, at least without sacrificing ballast efficiency.

Additional drawbacks of the foregoing R-C circuits are soft turn-off of the MOSFETs, resulting in poor switching, and a slowly decaying ramp of voltage provided to the R-C circuit, causing poor regulation of lamp power and undesirable variations in line voltage and arc impedance.

Regarding a second aspect of the invention, it would be desirable to provide a ballast circuit of the foregoing type having a starting circuit for the regenerative gate drive circuitry configured to allow use of a dry-type capacitor for smoothing the output of an a.c.-to-d.c. rectifier.

SUMMARY OF THE INVENTION

A aspect of the invention, claimed herein, provides a ballast circuit for a gas discharge lamp, including a rectifier coupled to convert current from an a.c. source to d.c. current provided on bus and reference conductors. A smoothing capacitance, coupled between the bus and reference conductors, smooths current supplied by the rectifier. A resonant load circuit includes a resonant inductance, a resonant capacitance, and means to connect to the lamp. A d.c.-to-a.c. converter circuit, coupled to the resonant load circuit, induces an a.c. current in the resonant load circuit. The converter circuit comprises first and second switches serially connected between the bus and reference conductors, and being connected together at a common node through which the a.c. load current flows. The switches each comprise a reference node and a control node, the voltage between such nodes determining the conduction state of the associated switch. The respective reference nodes of the switches are interconnected at the common node. The respective control nodes of the switches are interconnected. A control circuit for controlling the switches includes an inductance connected between the control nodes and the common node. A starting pulse-supplying capacitance is connected in series with the inductance, between the control nodes and the common node. A network is connected to the control and common nodes for supplying the starting pulse-supplying capacitance with charge so as to create a starting pulse thereacross during lamp starting effective on its own to start one of the switches. The capacitance substantially comprises at least one dry-type capacitor.

Beneficially, the foregoing ballast circuit uses a dry-type capacitor for smoothing the output of an a.c.-to-d.c. rectifier, for enhancing ballast durability. Advantageously, the circuit can operate from very low d.c. voltages while its converter switches turn on and off with negligible voltage across them. This condition is known in the art as "soft" switching, and is desirable to minimize heating of the switches.

DETAILED DESCRIPTION OF THE INVENTION

First Aspect of Invention

The first aspect of the invention will now be described in connection with FIGS. 1–7.

Figure 1:
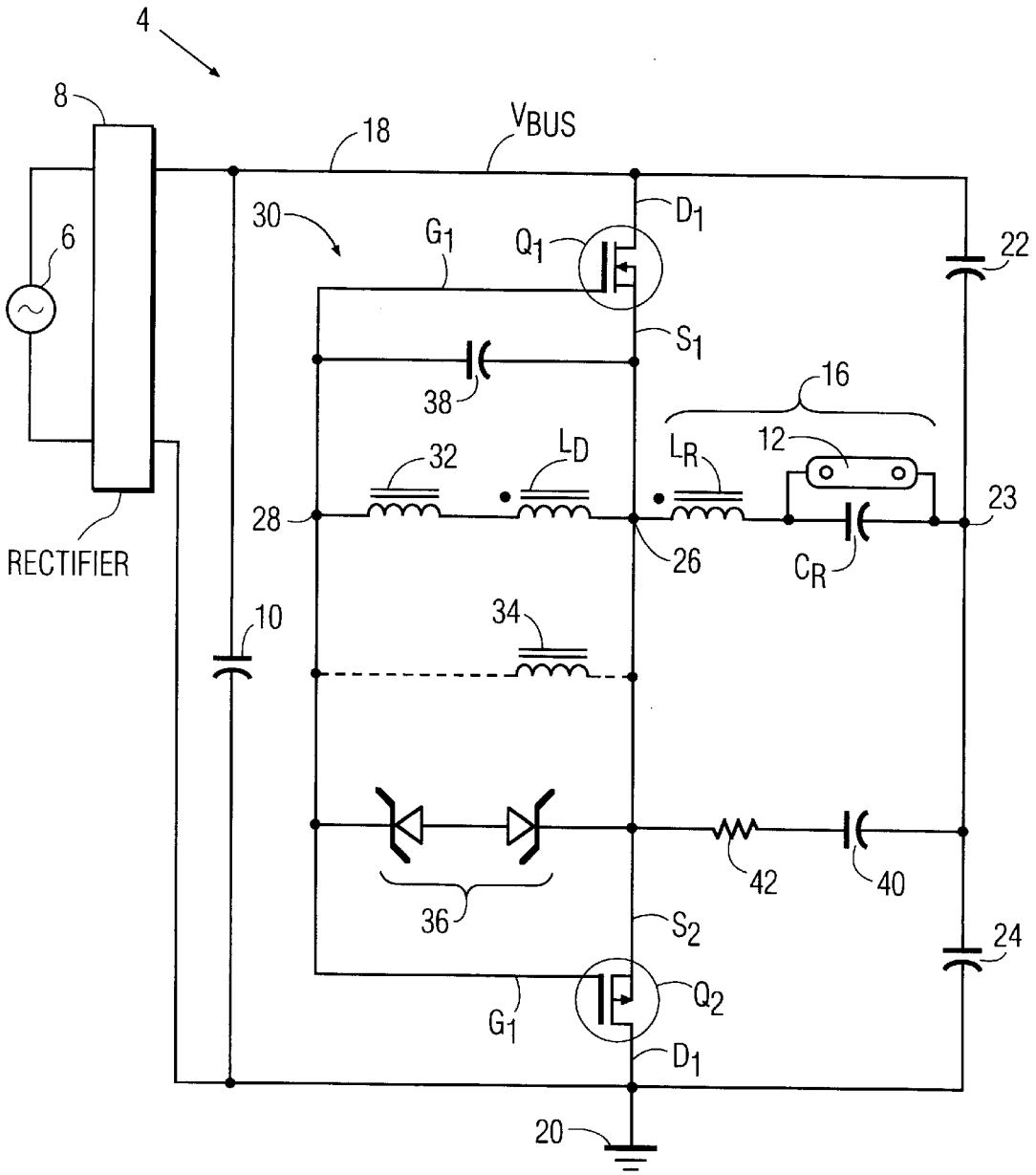
FIG. 1 is a schematic diagram of a ballast circuit for a gas discharge lamp employing complementary switches in a d.c.-to-a.c. converter, in accordance with a first aspect of the invention.

FIG. 1 shows a ballast circuit 4 for a gas discharge lamp 12 in accordance with a first aspect of the invention. An a.c. source 6 supplies current to an a.c.-to-d.c. rectifier 8, which may be a full-wave bridge rectifier. Typically, in addition, an electromagnetic interference filter (not shown) is interposed between source 6 and rectifier 8. A smoothing capacitor 10 is used to smooth the output from rectifier 8. Switches $Q_1$ and $Q_2$ are respectively controlled to convert d.c. current from rectifier 8 to a.c. current received by a resonant load circuit 16, comprising a resonant inductor $L_R$ and a resonant capacitor $C_R$. D.c. bus voltage $V_{BUS}$ exists between bus conductor 18 and reference conductor 20, shown for convenience as a ground. Resonant load circuit 16 also includes lamp 12, which, as shown, may be shunted across resonant capacitor $C_R$. Capacitors 22 and 24 are standard "bridge" capacitors for maintaining their commonly connected node 23 at about ½ bus voltage $V_{BUS}$. Other arrangements for interconnecting lamp 12 in resonant load circuit 16 and arrangements alternative to bridge capacitors 18 and 24 will be apparent to those of ordinary skill in the art.

In ballast 4 of FIG. 1, switches $Q_1$ and $Q_2$ are complementary to each other in the sense, for instance, that switch $Q_1$ may be an n-channel enhancement mode device as shown, and switch $Q_2$ a p-channel enhancement mode device as shown. These are known forms of MOSFET switches, but Bipolar Junction Transistor switches could also be used, for instance. Each switch $Q_1$ and $Q_2$ has a respective gate, or control terminal, $G_1$ or $G_2$. The voltage from gate $G_1$ to source $S_1$ of switch $Q_1$ controls the conduction state of that switch. Similarly, the voltage from gate $G_2$ to source $S_2$ of switch $Q_2$ controls the conduction state of that switch. As shown, sources $S_1$ and $S_2$ are connected together at a common node 26. With gates $G_1$ and $G_2$ interconnected at a common control node 28, the single voltage between control node 28 and common node 26 controls the conduction states of both switches $Q_1$ and $Q_2$. The drains $D_1$ and $D_2$ of the switches are connected to bus conductor 18 and reference conductor 20, respectively.

Gate drive circuit 30, connected between control node 28 and common node 26, controls the conduction states of switches $Q_1$ and $Q_2$. Gate drive circuit 30 includes a driving inductor $L_D$ that is mutually coupled to resonant inductor $L_R$, and is connected at one end to common node 26. The end of inductor $L_R$ connected to node 26 may be a tap from a transformer winding forming inductors $L_D$ and $L_R$. Inductors $L_D$ and $L_R$ are poled in accordance with the solid dots shown adjacent the symbols for these inductors. Driving inductor $L_D$ provides the driving energy for operation of gate drive circuit 30. A second inductor 32 is serially connected to driving inductor $L_D$, between node 28 and inductor $L_D$. As will be further explained below, second inductor 32 is used to adjust the phase angle of the gate-to-source voltage appearing between nodes 28 and 26. A further inductor 34 may be used in conjunction with inductor 32, but is not required, and so the conductors leading to inductor 34 are shown as broken. A bidirectional voltage clamp 36 between nodes 28 and 26 clamps positive and negative excursions of gate-to-source voltage to respective limits determined, e.g., by the voltage ratings of the back-to-back Zener diodes shown. A capacitor 38 is preferably provided between nodes 28 and 26 to predicably limit the rate of change of gate-to-source voltage between nodes 28 and 26. This beneficially assures, for instance, a dead time interval in the switching modes of switches $Q_1$ and $Q_2$ wherein both switches are off between the times of either switch being turned on.

An optional snubber circuit formed of a capacitor 40 and, optionally, a resistor 42 may be employed as is conventional, and described, for instance, in U.S. Pat. No. 5,382,882, issued on Jan. 17, 1995, to the present inventor, and commonly assigned.

Figure 2:
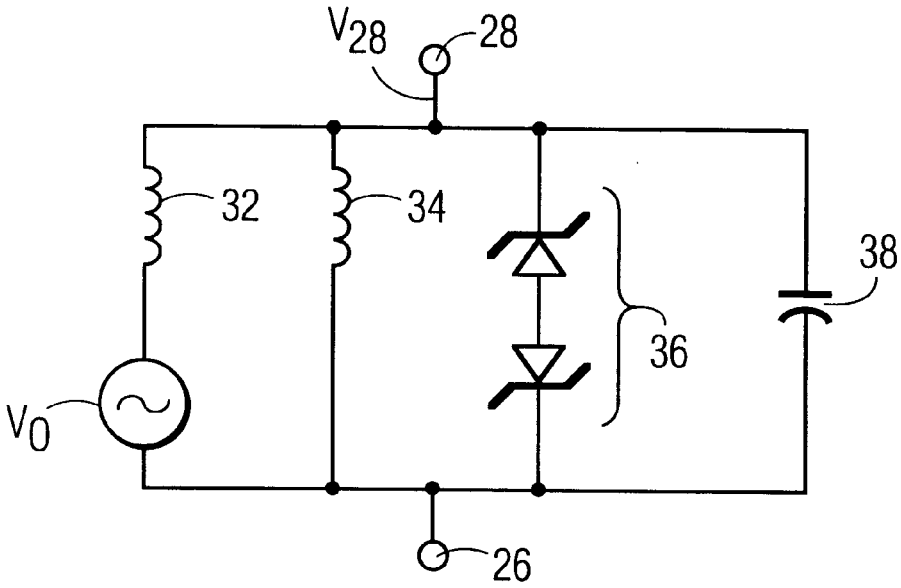
FIG. 2 is an equivalent circuit diagram for gate drive circuit 30 of FIG. 1.

FIG. 2 shows a circuit model of gate drive circuit 30 of FIG. 1. When the Zener diodes 36 are conducting, the nodal equation about node 28 is as follows:

$$-(1/L_{32})\int V_o dt+(1/L_{32}+1/L_{34})\int V_{28}dt+I_{36}=0 \quad (1)$$

where, referring to components of FIG. 1, $L_{32}$ is the inductance of inductor 32;

$V_o$ is the driving voltage from driving inductor $L_D$;

$L_{34}$ is the inductance of inductor 34;

$V_{28}$ is the voltage of node 28 with respect to node 26; and $I_{36}$ is the current through the bidirectional clamp 36.

In the circuit of FIG. 2, the current through capacitor 38 is zero while the voltage clamp 36 is on.

Figure 3:
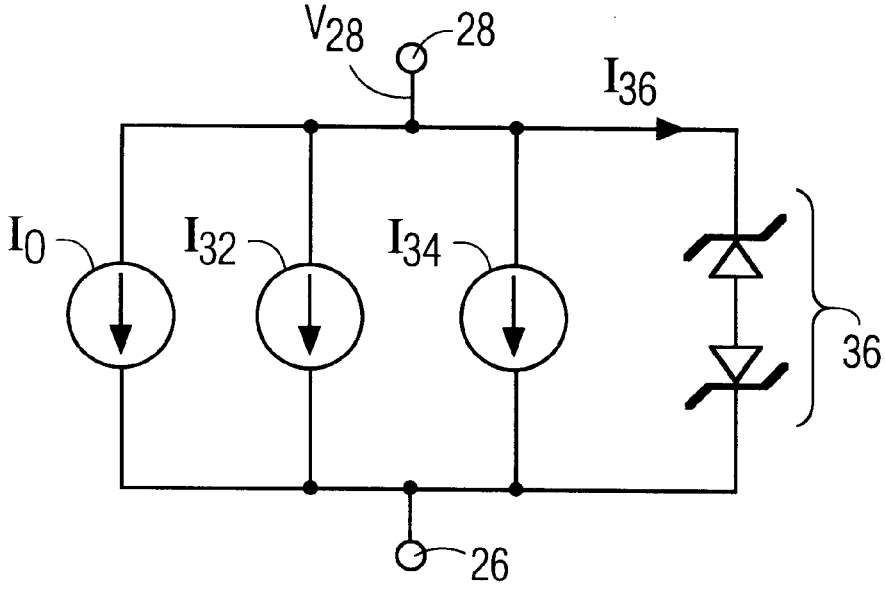
FIG. 3 is an another equivalent circuit diagram for gate drive circuit 30 of FIG. 1.

The circuit of FIG. 2 can be redrawn as shown in FIG. 3 to show only the currents as dependent sources, where $I_o$ is the component of current due to voltage $V_o$ (defined above) across driving inductor $L_D$ (FIG. 1). The equation for current $I_o$ can be written as follows:

$$I_o=(1/L_{32})\int V_0 dt \quad (2)$$

The equation for current $I_{32}$, the current in inductor 32, can be written as follows:

$$I_{32}=(1/L_{32})\int V_{28}dt \quad (3)$$

The equation for current $I_{34}$, the current in inductor 34, can be written as follows:

$$I_{34}=(1/L_{34})\int V_{28}dt \quad (4)$$

As can be appreciated from the foregoing equations (2)–(4), the value of inductor $L_{32}$ can be changed to include the values of both inductors $L_{32}$ and $L_{34}$. The new value for inductor $L_{32}$ is simply the parallel combination of the values for inductors 32 and 34.

Figure 4:
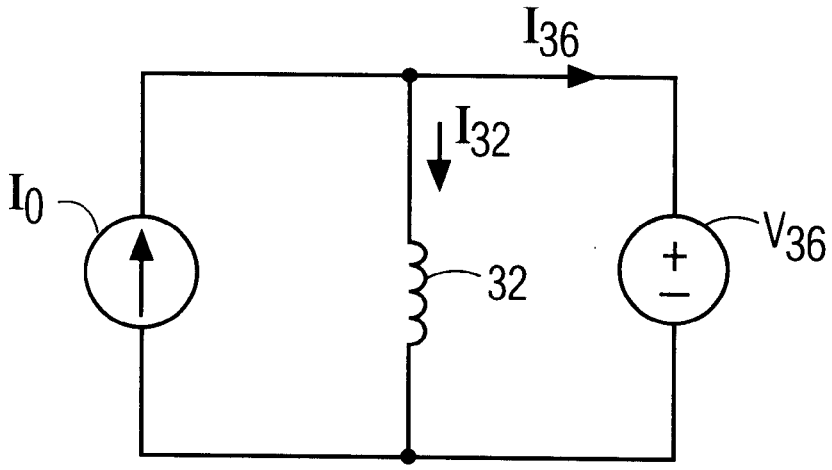
FIG. 4 is an equivalent circuit for gate drive circuit 30 of FIG. 1 when Zener diodes 36 of FIG. 1 are conducting.
Figure 5:
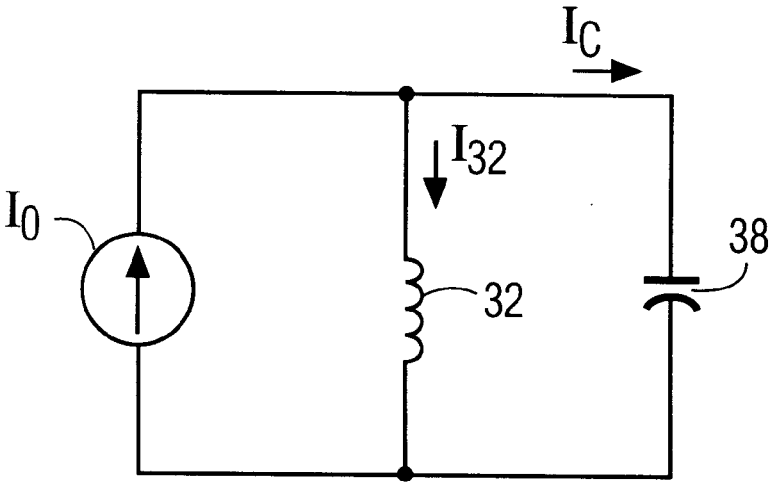
FIG. 5 is an equivalent circuit for gate drive circuit 30 of FIG. 1 when Zener diodes 36 of FIG. 1 are not conducting, and the voltage across capacitor 38 of FIG. 1 is changing state.

Now, with inductor 34 removed from the circuit of FIG. 1, the following circuit analysis explains operation of gate drive circuit 34. Referring to FIG. 4, with terms such as $I_o$ as defined above, the condition when the back-to-back Zener diodes of bidirectional voltage clamp 36 are conducting is now explained. Current $I_o$ can be expressed by the following equation:

$$I_o=(L_R/nL_{32})I_R \quad (5)$$

where $L_R$ (FIG. 1) is the resonant inductor;

n is the turns ratio as between $L_R$ and $L_D$; and $I_R$ is the current in resonant inductor $L_R$.

Current $I_{36}$ through Zener diodes 36 can be expressed by the following equation:

$$I_{36}=I_0-I_{32} \quad (6)$$

With Zener diodes 36 conducting, current through capacitor 38 (FIG. 1) is zero, and the magnitude of $I_o$ is greater than $I_{32}$. At this time, voltage $V_{36}$ across Zener diodes 36 (i.e. the gate-to-source voltage) is plus or minus the rated clamping voltage of one of the active, or clamping, Zener diode (e.g. 7.5 volts) plus the diode drop across the other, non-clamping, diode (e.g. 0.7 volts).

Then, with Zener diodes 36 not conducting, the voltage across capacitor 38 (FIG. 1) changes state from a negative value to a positive value, or vice-versa. The value of such voltage during this change is sufficient to cause one of switches $Q_1$ and $Q_2$ to be turned on, and the other turned off. As mentioned above, capacitor 38 assures a predictable rate of change of the gate-to-source voltage. Further, with Zener diodes 36 not conducting, the magnitude of $I_{32}$ is greater than the value of $I_0$. At this time, current $I_C$ in capacitor 38 can be expressed as follows:

$$I_C = I_o - I_{32} \quad (7)$$

Current $I_{32}$ is a triangular waveform. Current $_{36}I$ (FIG. 4) is the difference between $I_o$ and $I_{32}$ while the gate-to-source voltage is constant (i.e., Zener diodes 36 conducting). Current $I_C$ is the current produced by the difference between $I_o$ and $I_{32}$ when Zener diodes 36 are not conducting. Thus, $I_C$ causes the voltage across capacitor 38 (i.e., the gate-to-source voltage) to change state, thereby causing switches $Q_1$ and $Q_2$ to switch as described. The gate-to-source voltage is approximately a square wave, with the transitions from positive to negative voltage, and vice-versa, made predictable by the inclusion of capacitor 38.

Figure 6:
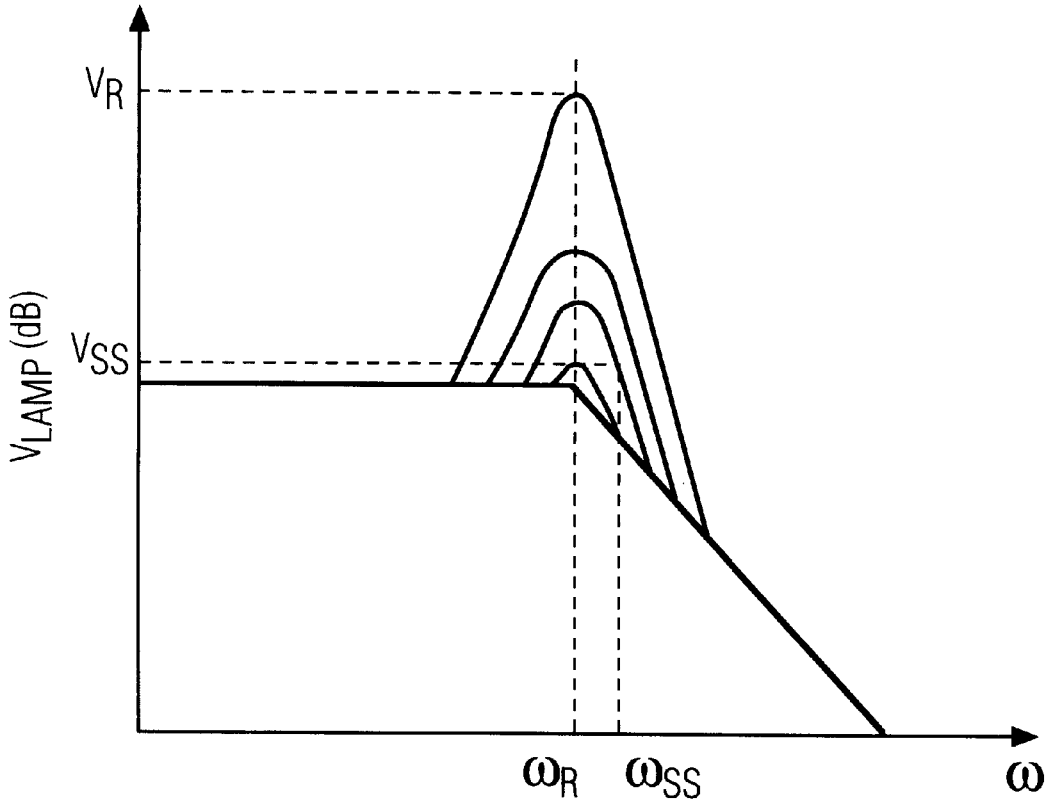
FIG. 6 is a simplified lamp voltage-versus-angular frequency graph illustrating operating points for lamp ignition and for steady state modes of operation.
Figure 7:
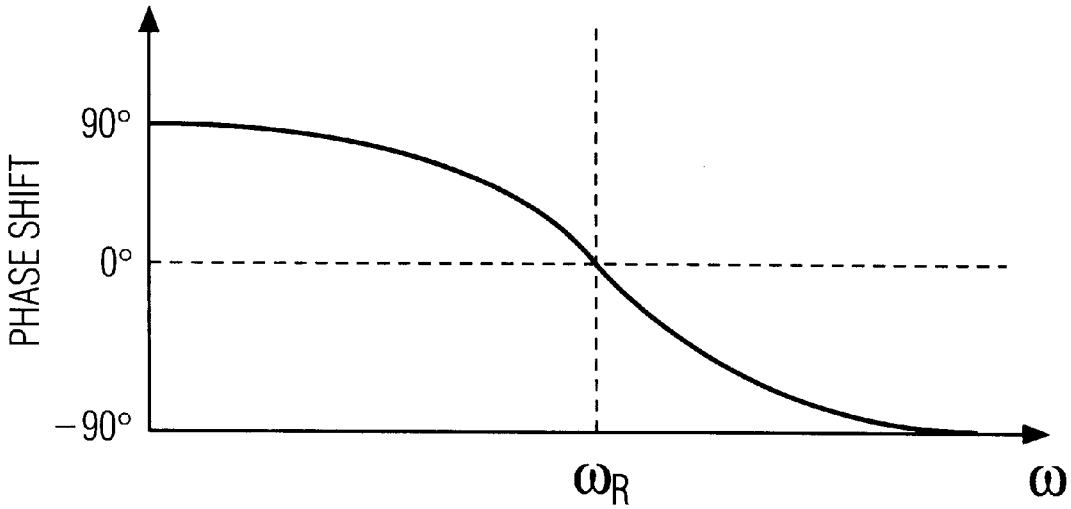
FIG. 7 illustrates the phase angle between a fundamental frequency component of a voltage of a resonant load circuit and the resonant load current as a function of angular frequency of operation.

Beneficially, the use of gate drive circuit 30 of FIG. 1 results in the phase angle between the fundamental frequency component of the resonant voltage between node 26 and node 23 and the current in resonant load circuit 16 (FIG. 1) approaching 0° during ignition of the lamp. With reference to FIG. 6, simplified lamp voltage $V_{LAMP}$ versus angular frequency curves are shown. Angular frequency $\omega_R$ is the frequency of resonance of resonant load circuit 16 of FIG. 1. At resonance, lamp voltage $V_{LAMP}$ is at its highest value, shown as $V_R$. It is desirable for the lamp voltage to approach such resonant point during lamp ignition. This is because the very high voltage spike generated across the lamp at such point reliably initiates an arc discharge in the lamp, causing it to start. In contrast, during steady state operation, the lamp operates at a considerably lower voltage $V_{SS}$, at the higher angular frequency $\omega_{SS}$. Now, referring to FIG. 7, the phase angle between the fundamental frequency component of resonant voltage between nodes 26 and 23 and the current in resonant load circuit 16 (FIG. 1) is shown. Beneficially, this phase angle tends to migrate towards 0° during lamp ignition. In turn, lamp voltage $V_{LAMP}$ (FIG. 6) migrates towards the high resonant voltage $V_R$ (FIG. 6), which is desirable, as explained, for reliably starting the lamp.

Some of the prior art gate drive circuits, as mentioned above, resulted in the phase angle of the resonant load circuit migrating instead towards 90° during lamp ignition, with the drawback that the voltage across the lamp at this time was lower than desired. Less reliable lamp starting thereby occurs in such prior art circuits.

Second Aspect of the Invention

Figure 8:
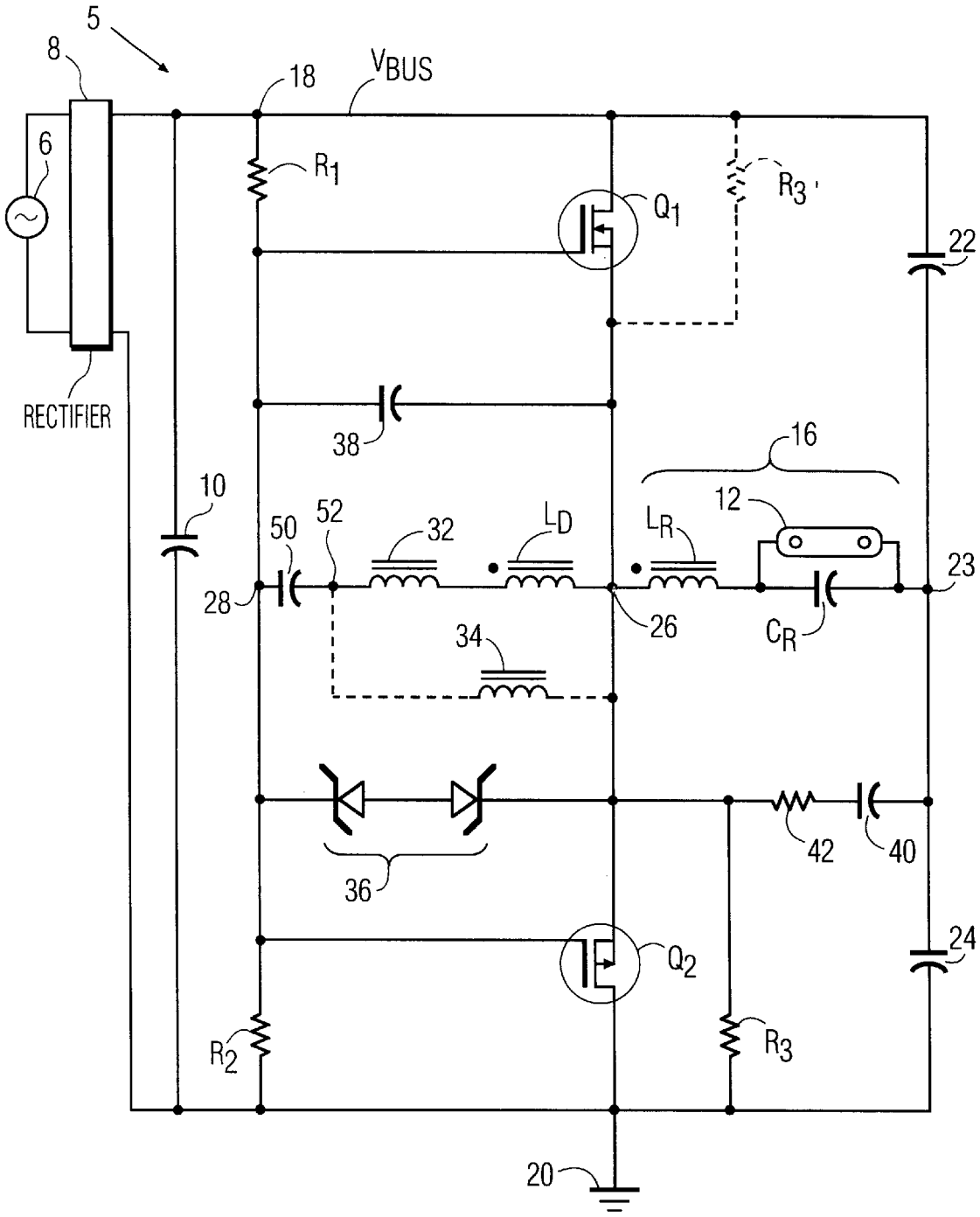
FIG. 8 is a schematic diagram similar to FIG. 1, but employing a starting circuit for allowing use of a durable, dry-type capacitor for smoothing the output of an a.c.-to-d.c. rectifier.

A second aspect of the invention is now described in connection with FIGS. 8–10. In FIG. 8, a ballast 5 is shown. It is similar to ballast 4 of FIG. 1, but includes a novel starting circuit described below. As between FIGS. 1 and 8, like reference numerals refer to like parts, and therefore FIG. 1 may be consulted for description of such like-numbered parts.

The starting circuit includes a coupling capacitor 50 that becomes initially charged, upon energizing of rectifier 8, via resistors $R_1$, $R_2$ and $R_3$. At this instant, the voltage across capacitor 50 is zero, and, during the starting process, serial-connected inductors $L_D$ and 32 act essentially as a short circuit, due to the relatively long time constant for charging capacitor 50. With resistors $R_1$–$R_3$ being of equal value, for instance, the voltage on node 26, upon initial bus energizing, is approximately ⅓ of bus voltage $V_{BUS}$, while the voltage at node 28, between resistors $R_1$ and $R_2$ is ½ of bus voltage $V_{BUS}$. In this manner, capacitor 50 becomes increasingly charged, from left to right, until it reaches the threshold voltage of the gate-to-source voltage of upper switch $Q_1$ (e.g., 2–3 volts). At this point, upper switch $_1Q$ switches into its conduction mode, which then results in current being supplied by that switch to resonant load circuit 16. In turn, the resulting current in the resonant load circuit causes regenerative control of first and second switches $Q_1$ and $Q_2$ in the manner described above for ballast circuit 4 of FIG. 1.

During steady state operation of ballast 5, the voltage of common node 26, between switches $Q_1$ and $Q_2$, becomes approximately ½ of bus voltage $V_{BUS}$. The voltage at node 28 also becomes approximately ½ bus voltage $V_{BUS}$, so that capacitor 50 cannot again, during steady state operation, become charged so as to again create a starting pulse for turning on switch $Q_1$. During steady state operation, the capacitive reactance of capacitor 50 is much smaller than the inductive reactance of driving inductor $L_D$ and inductor 32, so that capacitor 50 does not interfere with operation of those inductors.

Resistor $R_3$ may be alternatively placed as shown in broken lines as resistor $R_3'$, shunting upper switch $Q_1$ rather than lower switch $Q_2$. The operation of the circuit is similar to that described above with respect to resistor $R_3$ shunting lower switch $Q_2$. However, initially, common node 26 assumes a higher potential than node 28 between resistors $R_1$ and $R_2$, so that capacitor 50 becomes charged from right to left. The results in an increasingly negative voltage between node 28 and node 26, which is effective for turning on lower switch $Q_2$.

Resistors $R_1$ and $R_2$ are both preferably used in the circuit of FIG. 8; however, the circuit will function substantially as intended with resistor $R_2$ removed and using resistor $R_3$ as shown in solid lines. The use of both resistors $R_1$ and $R_2$ may result in a quicker start at a somewhat lower line voltage. The circuit will also function substantially as intended with resistor $R_1$ removed and using resistor $R_3$ as shown in dashed lines.

Beneficially, the novel starting circuit of circuit 5 of FIG. 8 does not require a triggering device, such as a diac, which is traditionally used for starting circuits. Additionally resistors $R_1$, $R_2$ and $R_3$ are non-critical value components, which may be 100 k ohms or 1 megohm each, for example. Preferably such resistors have similar values, e.g., approximately equal.

Exemplary component values for the circuit of FIG. 8 (and hence of FIG. 1) are as follows for a fluorescent lamp 12 rated at 16.5 watts, with a d.c. bus voltage of 160 volts, and not including inductor 34:

Smoothing capacitor 10 . . . 0.1 microfarads
Resonant inductor $L_R$ . . . 600 micro henries
Driving inductor $L_D$ . . . 2.2 micro henries
Turns ratio between $L_R$ and $L_D$ . . . 16.7
Second inductor 32 . . . 220 micro henries
Capacitor 38 . . . 5.6 nano farads
Capacitor 50 . . . 0.1 microfarads
Zener diodes 36, each . . . 10 volts
Resistors $R_1$, $R_2$ and $R_3$, each . . . 130 k ohm
Resonant capacitor $C_R$ . . . 6.8 nanofarads Bridge capacitors 22 and 24, each . . . 0.22 microfarads Snubber capacitor 40 . . . 680 picofarads Additionally, switch $Q_1$ may be an IRFR214, n-channel, enhancement mode MOSFET, sold by International Rectifier Company, of El Segundo, Calif.; and switch $Q_2$, an IRFR9214, p-channel, enhancement mode MOSFET also sold by International Rectifier Company.

If inductor 34 is used in the embodiment of FIG. 8, the left-shown end of the inductor should be connected to node 52, i.e., the node between inductor 32 and capacitor 50, as shown.

Figure 9:
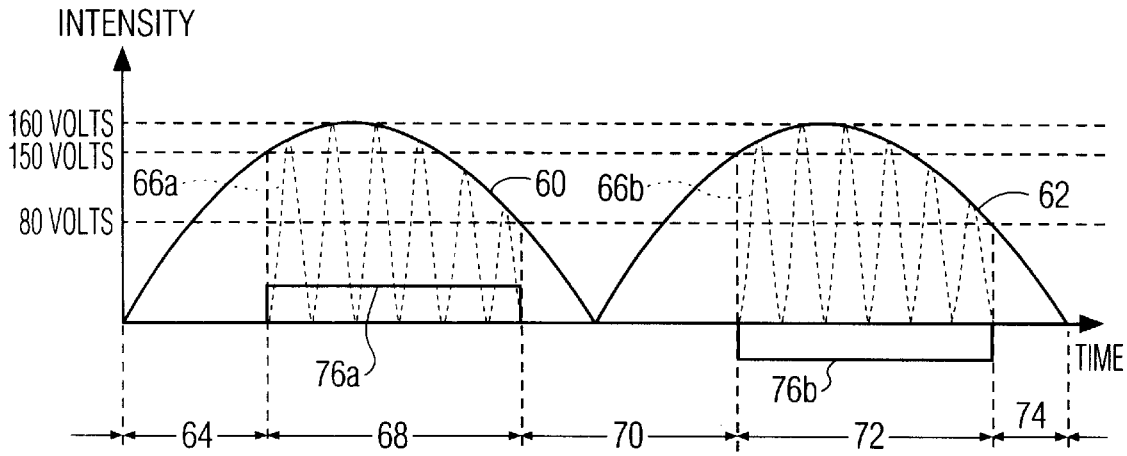
FIG. 9 PRIOR ART
FIGS. 9 and 10 show various circuit waveforms as produced by a prior art circuit and the invention, respectively.
Figure 10:
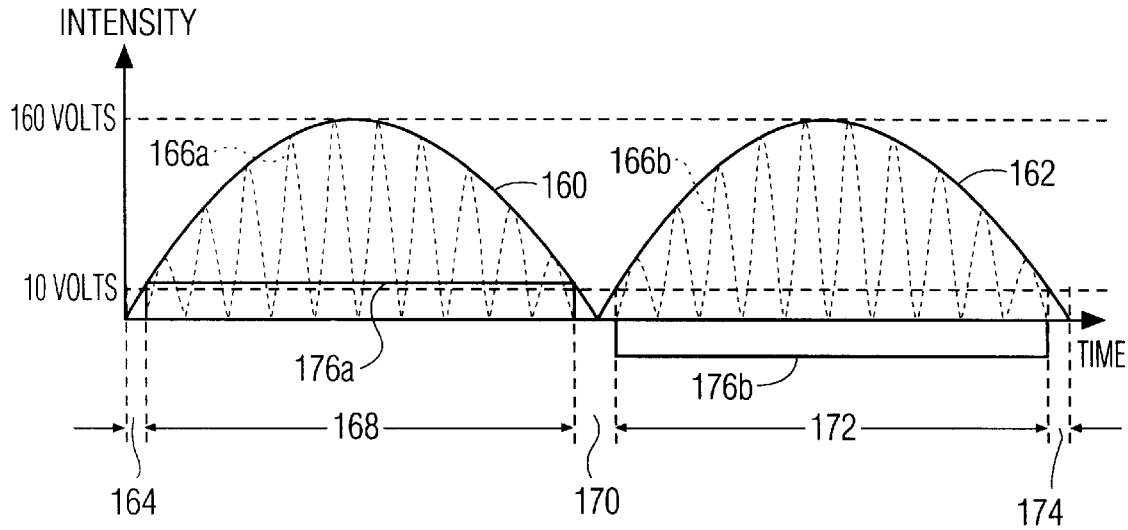

FIGS. 9 and 10 contrast various circuit waveforms as produced by a prior art circuit (FIG. 9) and the present invention (FIG. 10), to show more continuous a.c. current draw from the invention.

In FIG. 9, waveforms 60 and 62 are consecutive half cycles of rectified voltage. A typical prior art circuit employs a voltage-breakover device, such as a diac, for starting regenerative operation of gate control circuitry for the converter switches. Such devices typically have a voltage-breakover threshold requiring, for instance, 150 volts of bus voltage to fire. Thus, only after expiration of time interval 64 does the ballast circuit start operation, indicated by an oscillating voltage curve 66*a*. The ballast circuit stops operation after expiration of time period 68 when voltage waveform 60 drops to, e.g., 80 volts, and does not restart until voltage waveform 62 reaches, e.g., 150 volts, after expiration of time period 70. The circuit oscillates as indicated by voltage curve 66*b* until the end of time interval 72, and is off during subsequent time interval 74. The offset in averaged a.c. current 76*a* and 76*b* to the right of center of their respective half cycles significantly contributes to a low power factor, arising from frequency components of the a.c. input current being out of phase with the a.c. input voltage.

While the ballast circuit oscillates, averaged a.c. current 76*a* is drawn during half-cycle 60, and averaged negative a.c. current 76*b* is drawn during half-cycle 62.

FIG. 10 uses reference numerals similar to those in FIG. 9, to show similarity, but are increased by "100." Because the ballast circuit of the invention does not use a voltage-breakover device for starting regenerative operation of its gate control circuitry, the circuit can start at a relatively lower d.c. bus voltage of, for instance, 10 volts. This considerably reduces the time intervals 164, 170 and 174 during which averaged a.c. currents 176*a* and 176*b* are zero, directly resulting in a high power factor for a.c. current supplied by the a.c. source. Further, the averaged a.c. currents 176*a* and 176*b* are more centered in their respective half cycles; this increases power factor. An economical circuit can readily obtain a power factor of at least about 0.85, and, more preferably, at least about 0.9.

With a.c. current being much more continuously supplied to the ballast circuit, smoothing capacitor 10 (FIG. 8) needs to store a much reduced amount of energy compared to a typical prior art circuit. As such, smoothing capacitor 10 can be realized by a dry-type (i.e. non-electrolytic as defined above) capacitor having a much reduced value from a typical electrolytic capacitor. Since wearing out of an electrolytic capacitor is a typical limiting factor in a ballast circuit of the type described herein, e.g., after 10,000 hours of use, replacing it with a dry-type capacitor substantially increases lifetime of the ballast. Additionally, the circuit can operate from very low d.c. voltages with its converter switches turning on and off with negligible voltage across them, i.e., with soft switching, to minimize deleterious switch heating.

While the invention has been described with respect to specific embodiments by way of illustration, many modifications and changes will occur to those skilled in the art. For instance, although lamp 12 (FIGS. 1 and 8) may have cathodes, it could alternatively be an electrodeless lamp. It is therefore, to be understood that the appended claims are intended to cover all such modifications and changes as fall within the true spirit and scope of the invention.

What is claimed is:

1. A ballast circuit for a gas discharge lamp, comprising:

(a) a rectifier coupled to convert current from an a.c. source to d.c. current provided on bus and reference conductors;

(b) a smoothing capacitance coupled between said bus and reference conductors for smoothing current supplied by said rectifier;

(c) a resonant load circuit including a resonant inductance, a resonant capacitance, and means to connect to the lamp;

(d) a d.c.-to-a.c. converter circuit coupled to said resonant load circuit for inducing an a.c. current in said resonant load circuit, said converter circuit comprising:

(i) first and second switches serially connected between said bus and reference conductors, and being connected together at a common node through which said a.c. load current flows;

(ii) said first and second switches each comprising a reference node and a control node, the voltage between such nodes determining the conduction state of the associated switch;

(iii) the respective reference nodes of said first and second switches being interconnected at said common node; and (iv) the respective control nodes of said first and second switches being interconnected;

(e) a control circuit for controlling said first and second switches, including an inductance connected between said control nodes and said common node;

(f) a starting pulse-supplying capacitance connected in series with said control circuit inductance, between said control nodes and said common node; and (g) a network connected to said control and common nodes for supplying said starting pulse-supplying capacitance with sufficient charge so as to create a starting pulse thereacross during lamp starting for starting one of said first and second switches;

(h) said smoothing capacitance substantially comprising at least one dry-type capacitor.

2. The ballast circuit of claim 1, further comprising a bidirectional voltage clamp connected between said control nodes and said common node.

3. The ballast circuit of claim 1, wherein said control circuit is so constructed as to result in a power factor for current supplied by said a.c. source of at least about 0.85.

4. The ballast circuit of claim 1, wherein said inductance comprises:

(a) a driving inductor mutually coupled to said resonant inductor in such manner that a voltage is induced therein which is proportional to the instantaneous rate of change of said a.c. load current; and (b) a second inductor serially connected to said control circuit driving inductor, with the serially connected driving and second inductors being connected between said control nodes and said common node.

5. The ballast circuit of claim 1, wherein said network comprises a voltage-divider network connected between said bus and reference conductors.

6. The ballast circuit of claim 5, wherein said voltage-divider network comprises a pair of resistors connected between said bus and reference conductors.

7. The ballast circuit of claim 6, wherein said network further comprises a polarity-determining impedance connected between said common node and one of said bus conductor and said reference conductor, to set the initial polarity of pulse to be generated by said starting pulse-supplying capacitor polarity-determining impedance comprises a resistor.

8. The ballast circuit of claim 1, wherein said lamp comprises a fluorescent lamp.

9. A ballast circuit for a gas discharge lamp, comprising:

(a) a rectifier coupled to convert current from an a.c. source of to d.c. current;

(b) a smoothing capacitance coupled between said bus and reference conductors for smoothing current supplied by said rectifier;

(c) a resonant load circuit including a resonant inductance, a resonant capacitance, and means to connect to the lamp;

(d) a d.c.-to-a.c. converter circuit coupled to said resonant load circuit for inducing an a.c. current in said resonant load circuit, said converter circuit comprising:

(i) first and second switches serially connected between said bus and reference conductors, and being connected together at a common node through which said a.c. load current flows;

(ii) said first and second switches each comprising a reference node and a control node, the voltage between such nodes determining the conduction state of the associated switch;

(iii) the respective reference nodes of said first and second switches being interconnected at said common node; and (iv) the respective control nodes of said first and second switches being interconnected;

(e) a control circuit for controlling said first and second switches, including an inductance connected between said control nodes and said common node, comprising:

(i) a driving inductor mutually coupled to said resonant inductor in such manner that a voltage is induced therein which is proportional to the instantaneous rate of change of said a.c. load current;

(ii) a second inductor serially connected to said driving inductor, with the serially connected driving and second inductors being connected between said control nodes and said common node; and (iii) a bidirectional voltage clamp connected between said control nodes and said common node;

(f) a capacitance coupled between said control nodes and said common node for predictably limiting the rate of change of voltage between said control nodes and said common node;

(g) a starting pulse-supplying capacitance connected in series with said control circuit inductance, between said control nodes and said common node; and (h) a network connected to said control and common nodes for supplying said starting pulse-supplying capacitance with sufficient charge so as to create a starting pulse thereacross during lamp starting for starting one of said first and second switches;

(i) said smoothing capacitance substantially comprising a least one dry-type capacitor.

10. The ballast circuit of claim 9, wherein said control circuit is so constructed as to result in a power factor for current supplied by said a.c. source of greater than about 0.85.

11. The ballast circuit of claim 10, wherein said network comprises a voltage-divider network connected between said bus and reference conductors.

12. The ballast circuit of claim 11, wherein said voltage-divider network comprises a pair of resistors connected between said bus and reference conductors.

13. The ballast circuit of claim 12, wherein said network further comprises a polarity-determining impedance connected between said common node and one of said bus conductor and said reference conductor, to set the initial polarity of pulse to be generated by said starting pulse-supplying capacitor polarity-determining impedance comprises a resistor.

14. The ballast circuit of claim 9, wherein said lamp comprises a fluorescent lamp.

* * * * *